United States Patent [19]

Clark et al.

[11] Patent Number: 4,520,973

[45] Date of Patent: Jun. 4, 1985

[54] STABILIZED GIMBAL PLATFORM

[75] Inventors: Keith E. Clark; Charles E. Woods, both of Ridgecrest, Calif.

[73] Assignee: The United States of America as represented by the Secretary of the Navy, Washington, D.C.

[21] Appl. No.: 484,050

[22] Filed: Apr. 11, 1983

[51] Int. Cl.[3] ..... F42B 15/02; F41G 7/22

[52] U.S. Cl. ..... 244/3.16

[58] Field of Search ..... 244/3.2, 3.21, 3.16

[56] References Cited

U.S. PATENT DOCUMENTS

| | | | |
|---|---|---|---|
| 2,963,973 | 12/1960 | Estey | 244/3.16 |
| 4,010,365 | 3/1977 | Meyers et al. | 244/3.16 |
| 4,068,538 | 1/1978 | Butler et al. | 244/3.2 |
| 4,085,910 | 4/1978 | Baker et al. | 244/3.16 |

*Primary Examiner*—Charles T. Jordan

*Attorney, Agent, or Firm*—Robert F. Beers; W. Thom Skeer; Kenneth G. Pritchard

[57] ABSTRACT

A stabilized gimbal platform is provided by use of rate gyro stabilized axes of a gimbal ring. A bail gimbal is used with both pitch and yaw inner gimbals to provide low friction stabilization over a large angular pointing range. This bail ring combination surrounds a lens assembly sensor, an automatic light level control device suitable to search for and track targets in a given frequency or wavelength range. By aiming, the gimbal arrangement permits the entire lens sensor arrangement to actually point and steer towards the desired target direction. The bail is balanced with drive assembly to provide stability to the bail. The bail itself is not mounted on its axis of rotation but rather is off-axis mounted on bearings for support and driven by an off-axis torque motor drive. The bail assembly can be driven by a metal band to provide smooth rotation of the bail assembly.

12 Claims, 11 Drawing Figures

STABILIZED GIMBAL PLATFORM

BACKGROUND OF THE INVENTION

1. Field of the Invention

The present invention relates to stabilized gimbal platforms and in particular relates to stabilized gimbal platforms suitable for missile seekers which have two axis gimbal rings mounted within a bail gimbal.

2. Description of the Prior Art

Rate gyro stabilized platforms have been used for several decades. The customary design for such a rate gyro stabilized platform consists of a gimbal ring interface with pitch and yaw rotational freedom between the moving platform and the fixed body. Given a platform size the body diameter reduces the gimbal angles possible as the body diameter decreases. To provide three dimensional stability, or larger gimbal angles, a conventional approach calls for the addition of a roll axis behind the yaw and pitch axes. An alternate approach to achieving large gimbal angles in a small body diameter is to support one platform axis on a bail gimbal with off-axis bearings for support and an off-axis torque motor drive. However, the off-axis bail gimbal presents high friction of the bail gimbal which restricts precise stabilization.

The restriction of bail gimbals for precise stabilization has become magnified in current missile bodies which seek to perform at higher turning accelerations. A small body diameter is desirable. Small bodies have less aerodynamic friction and permit a larger number of missiles to be carried by a launch platform such as an aircraft. Further, although a two-axis bail gimbal allows packaging a large stabilized platform with large gimbal angles in a small missile body diameter, the stabilization is poor due to high friction.

SUMMARY OF THE INVENTION

The major parts of the seeker are a platform set in a two axis gimbal ring which is in turn mounted on a bail gimbal. The entire combination is then mounted in a support frame which captures the bail and provides the drive assembly to rotate it. Within the gimbal ring, a lens system such as a catadioptric lens system is placed in front of a sensor, such as a CCD sensor. They are mounted with a light level control placed before the sensor to expand the dynamic range. One or two rate gyros are mounted on the platform to control the two axis gimbal ring and to provide precision steering of the missile. A thermoelectric cooler and heat sink are mounted to the CCD to provide improved control. CCD camera electronics are mounted on the support frame.

The gimbal ring serves as the intermediate member for the inner two axes of rotation located between the platform and the bail. Each of these rotation axes is supported by two pairs of DF preloaded ball bearings. At one end of the axis, the bearing pair is built into a resolver assembly, the resolver being used for a gimbal angle measurement. The bearing pair at the other end is located in a DC torque motor assembly which is directly coupled to drive the gimbal. The bail gimbal provides wide angle steering for one of the two axes of the gimbal ring. To achieve wide angle steering of the second axis, the inner ring is rotated 90°.

DESCRIPTION OF THE PREFERRED EMBODIMENT

Figure 1:
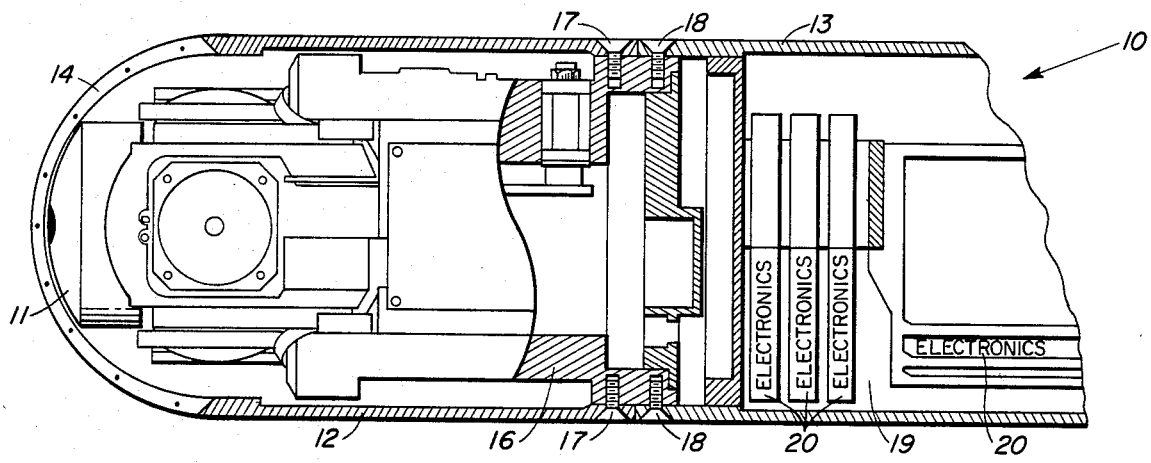
FIG. 1 is a cutaway of a missile section holding the present invention.

FIG. 1 is a cutaway view of a missile 10 housing a seeker 11. The missile has an outer enclosure 12 which ends in a frontal enclosure 14 which is transparant to radiation of the desired frequency. Missile 10 has an outer wall 13 which serves as a support wall. A support frame 16 is mounted to wall 13 via screws 18 or similar fasteners. Outer enclosure 12 is held to support frame 16 by screws 17. Compartment 19 behind support frame 16 is an electronic control assembly that holds the bulk of the electronics 20 needed for processing information from seeker 11. Electronics 20 is a matter of choice depending on the type of information which is to be extracted from seeker 11. As shown, electronics 20 includes several printed circuit boards with different orientations.

Figure 2:
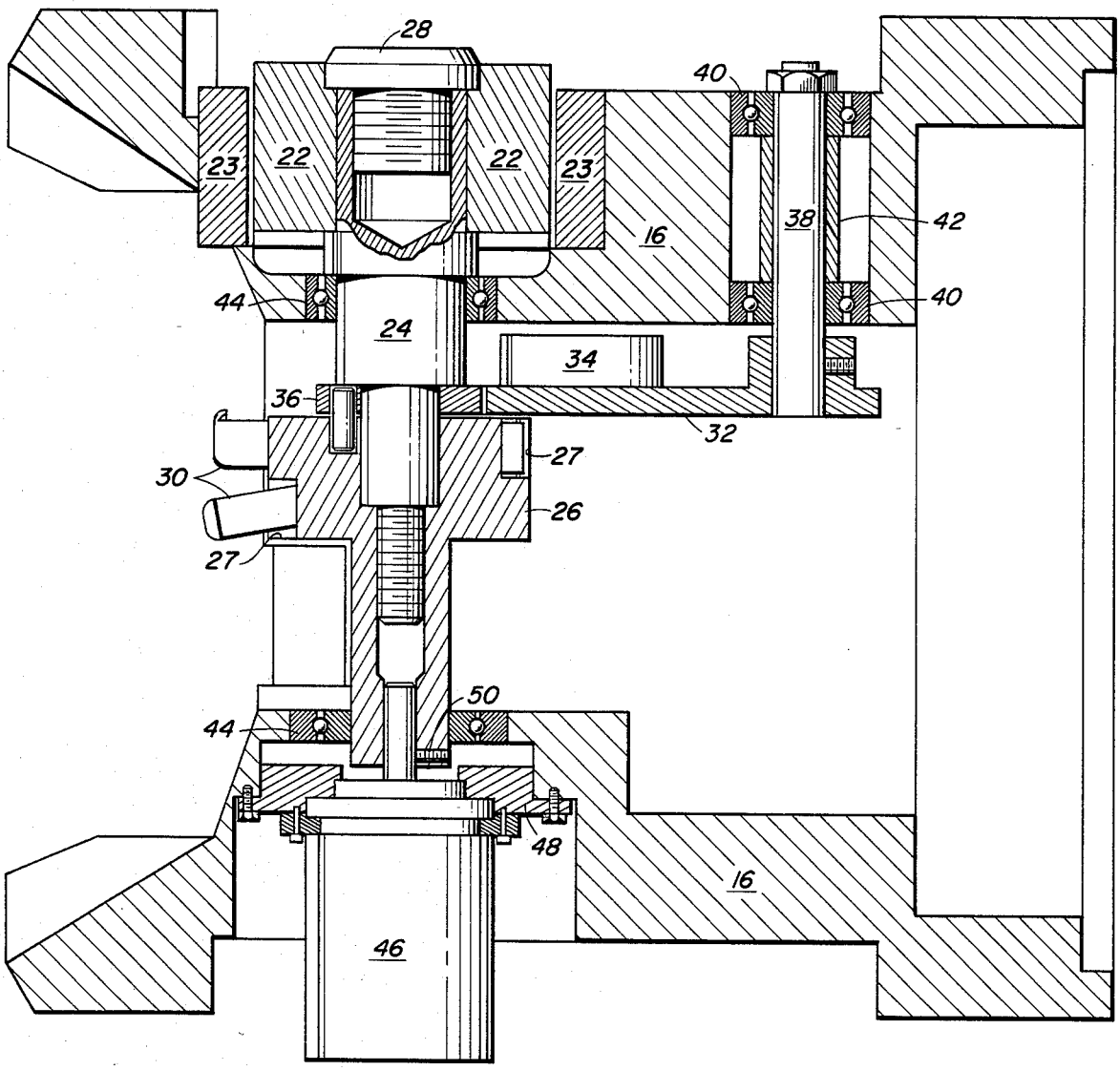
FIG. 2 is a cutaway view of the support frame and bail drive assembly of the present invention.

FIG. 2 is a cutaway view of the gimbal drive assembly. Support frame 16 has a DC torque motor rotor 22 mounted within support frame 16 next to stator 23. Driven by torque motor rotor 22 is a torquer spindle 24 which in turn is mounted to a drive pulley assembly 26. Drive pulley assembly 26 and torquer spindle 24 may be mounted through a threaded arrangement, as shown, or in any other mounting arrangement. A torquer clamp 28 is used to retain the torquer rotor. Drive pulley assembly 26 has mounts 27 for bail drive bands 30 or a set of teeth. The teeth will be explained in relation to the bail gimbal further on. When torquer spindle 24 rotates via drive pulley assembly 26, bail drive bands 30 in turn rotate the bail gimbal. Drive bands 30 are fastened to the bail gimbal on opposite sides to pull it in either of two opposing directions. To provide balance, counterweight gear segment 32 is necessary to shift counterweight 34 to keep the bail gimbal center of gravity in balance. Counterweight gear segment 32 has teeth which mesh with drive gear 36 which permit counterweight 34 to swing back and forth around a counterweight shaft 38. Counterweight shaft 38 is in turn bolted to support frame 16 via bearings 40 which are mounted around a counterweight shaft spacer 42. The end of drive pulley assembly 26 is mounted in bearings 44 and connected to a servomount potentiometer 46 mounted via a potentiometer mounting plate 48. Servo-mount potentiometer 46 indicates the orientation of drive pulley assembly 26 which corresponds to the orientation of the bail gimbal. Servo-mount potentiometer 46 can be replaced by any device which serves as a resolver of the orientation of torquer spindle 24 and drive pulley assembly 26. Attachment of drive pulley assembly 26 to potentiometer 46 is made via set screw 50. Adjustment is permitted by rotation of potentiometer 46 in plate 48.

Figure 3:
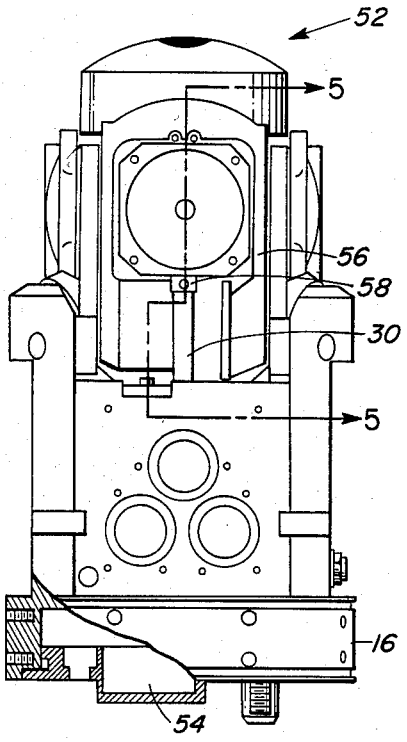
FIG. 3 is a side view of a support frame suitable for the invention with the bail and inner gimbal ring.
Figure 4:
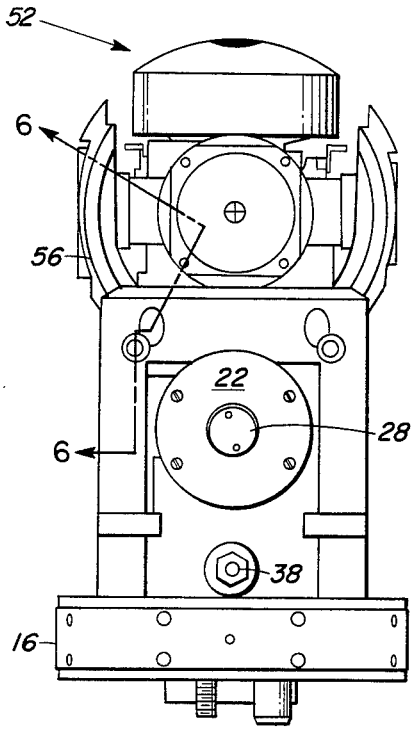
FIG. 4 is a side view similar to FIG. 3 except the support frame and bail are rotated 90° with respect to FIG. 3.

FIGS. 3 and 4 show side views of the seeker assembly 52. Seeker assembly 52 includes support frame 16 with seeker electronics 54 mounted in the base. Like numbers refer to the same parts shown in other figures and will be continued into the other figures. Mounted at one end of support frame 16 is a bail gimbal 56. Bail gimbal 56 is connected to drive pulley assembly 26 via an adjustable belt mechanism 58 which includes a bail drive band 30, such as metal bands, which are driven by drive pulley assembly 26.

Figure 6:
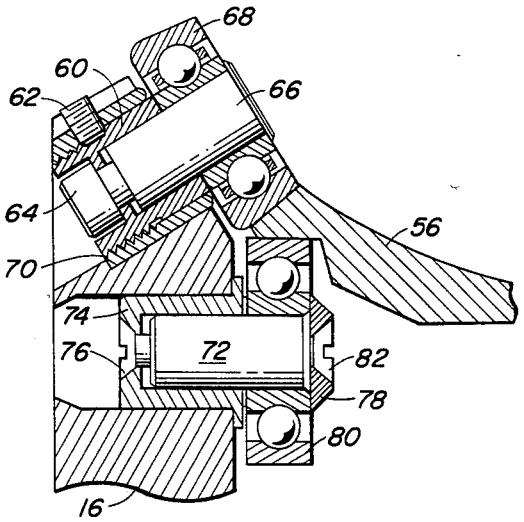
FIG. 6 is a cross-section of the bail, support rollers, and support frame.

A perspective cutaway along the arrow shown as 6—6 in FIG. 4 shows the method of supporting bail gimbal 56 in an off-axis manner in FIG. 6. A pinch roller spindle 60 is set in support frame 16 via a set screw 62. Pinch roller spindle 60 is threaded as shown for insertion in support frame 16 and is adjusted via a cap screw 64. One end of pinch roller spindle 60 contains a shaft 66 set within a bearing 68 via a pinch roller sleeve 70. Supporting bail gimbal 56 is an adjustable support roller spindle 72 which is also set in support frame 16 within a roller support sleeve 74. Adjustment support roller spindle 72 uses a combination of bearing, shaft, and bearing sleeve arrangement as pinch roller spindle 60 previously described. A support roller retainer 78 clamps a bearing 80 via screw 82. Adjustment screw 76 is provided to clamp adjustable support spindle 72. This spindle may be fabricated with eccentric positioning of the spindle end for vertical adjustment of the bearing position.

Figure 5:
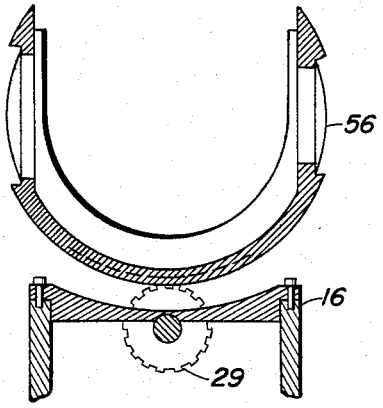
FIG. 5 is a cross-section of the bail with a gear drive.

FIG. 5 is a cross section of a bail with a gear drive. Gear drive is an alternate way to direct the orientation of the bail without the use of a drive pulley assembly. In this alternative, bail 56 has a gear drive assembly 29 which is mounted in support frame 16. Gear drive assembly 29 is used in place of drive pulley assembly 26 shown in FIG. 2. In general, gear teeth do not provide control as precise as a drive band.

Figure 7:
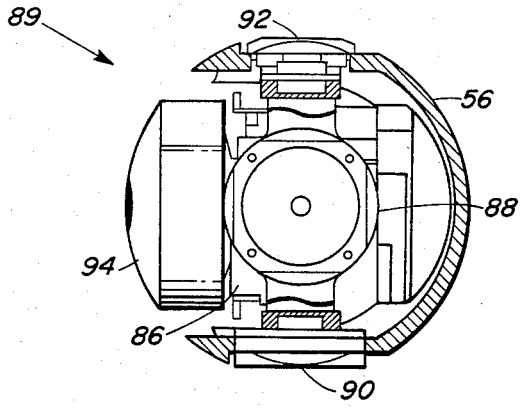
FIG. 7 is a cross-sectional view of the outer gimbal assembly.
Figure 8:
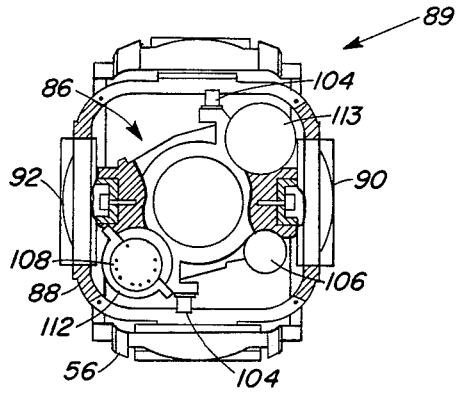
FIG. 8 is a rotated cross sectional view of FIG. 7 with the lens removed.
Figure 9:
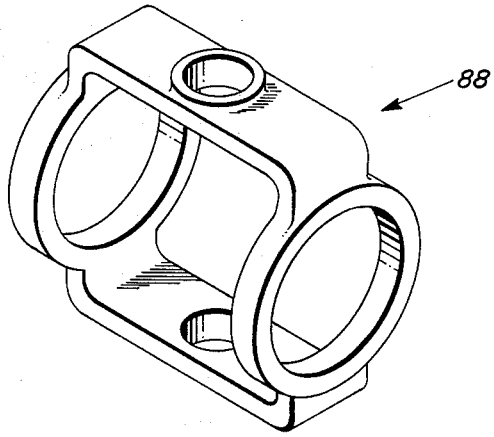
FIG. 9 is a perspective of a two axis gimbal ring.

FIG. 7 and FIG. 8 are cutaways of the outer gimbal assembly 89. FIG. 8 is rotated 90° with respect to FIG. 7 and a lens assembly 94 is not shown in FIG. 8. Outer gimbal assembly 89 includes an inner platform assembly 86 which is mounted with a two axis gimbal ring 88. Each of the two inner axes has a gimbal torquer assembly 90 on one end of the gimbal ring 88 and a resolver assembly 92 on the opposite end. Resolver assembly 92 measures the change in rotation about the axis it is mounted on and provides an output to the seeker base electronics 54 to provide a characteristic signal of the orientation about each of the axes. Such resolvers are commercially available from companies, such as Vernitron Corporation.

Figure 10:
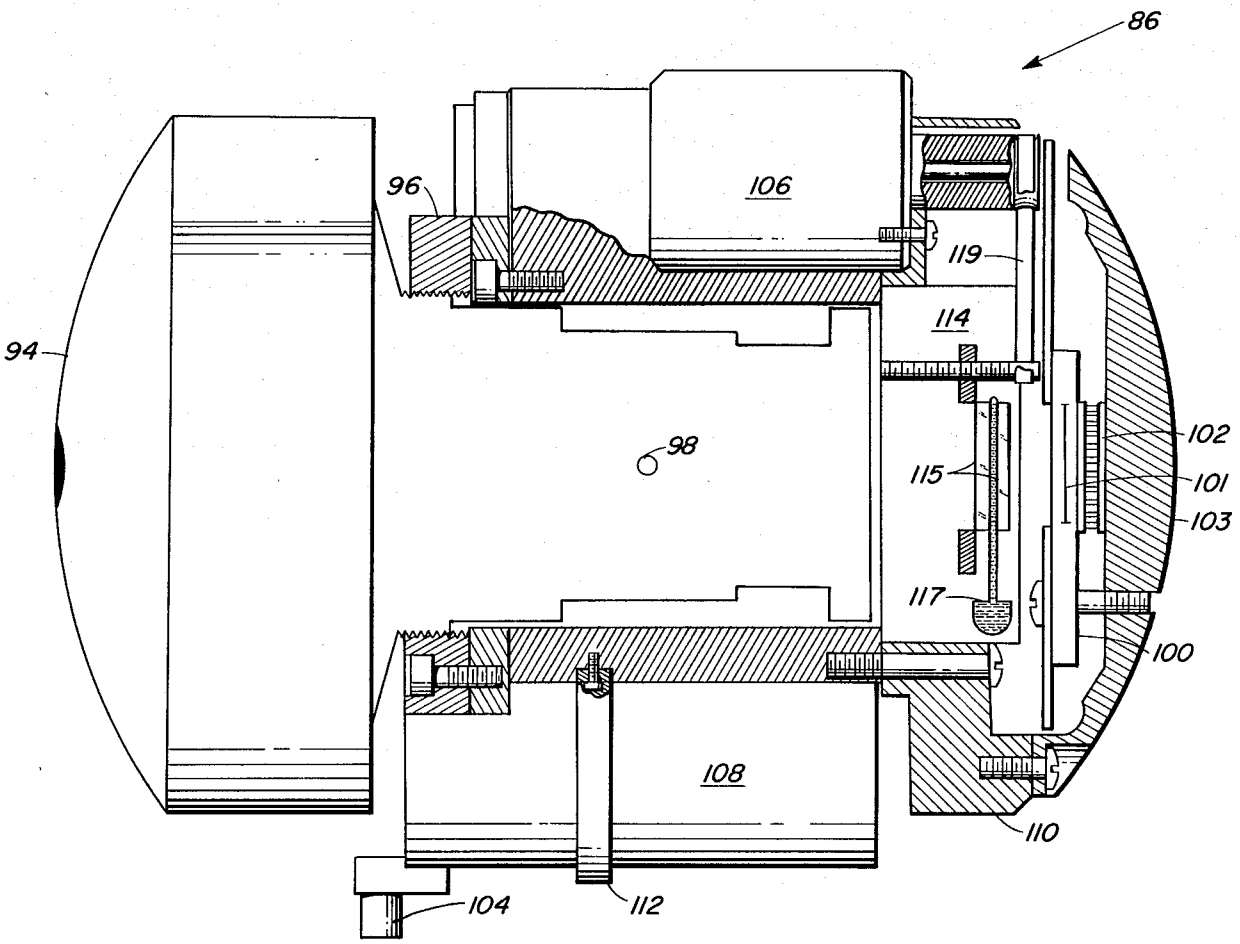
FIG. 10 is a cross sectional view of an inner platform assembly.

FIG. 10 shows inner gimbal assembly 86 with a lens assembly 94 which may be a catadioptric lens system mounted to a lens adapter plate 96 about a gimbal center 98. Mounted about gimbal center 98 is a sensor 100 which is in direct contact with a thermoelectric cooler 102. Thermoelectric cooler 102 is also in direct contact with a heat sink 103. Inner gimbal stops 104 limit the swing of inner platform assembly 86. Included on inner platform assembly 86 is an automatic light level control motor 106, a rate sensor 108 and a camera mounting plate 110. A gyro clamp 112 holds rate sensor 108. If a single axis sensor is used, as shown, a counterweight 113, shown in FIG. 8, is used to balance platform assembly 86. If two single axis sensors are used, the second one replaces counterweight 113.

A fluid light attenuator 114 is shown between lens system 94 and sensor 100. Fluid light attenuator 114 has two transparent pieces of glass 115 which sandwich a neutral density fluid 117. The distance between pieces of glass 115 is varied by light level control motor 106 via a belt drive 119.

Figure 11:
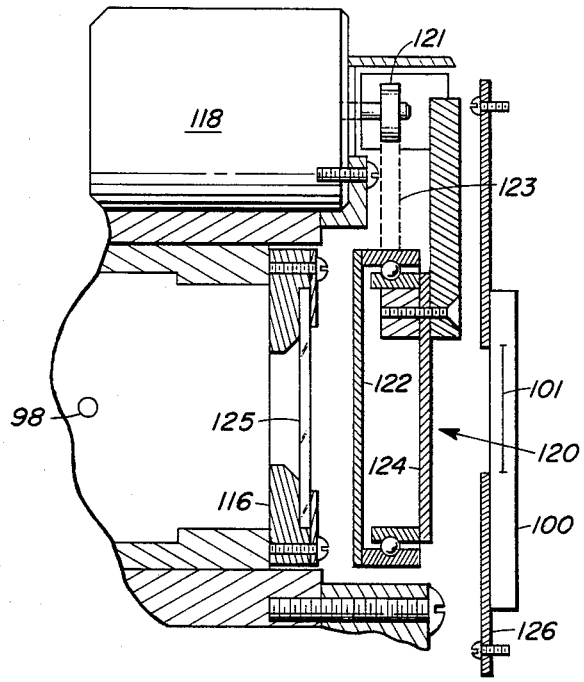
FIG. 11 is a cross section of an alternate light attenuator system.

FIG. 11 shows an alternate apparatus for attenuating light prior to sensor 100. Connected to a DC gear motor 118 is a pulley 121 with a flexible belt drive 123. An optical filter 125 is attached to lens system 94 by means of a filter holder 116. Optical filter 125 limits light to be attenuated to a predetermined spectral range. Light level is controlled by having DC gear motor 118 connected to a rotating polarizer 120 which rotates a sheet of polarizing material 122 with respect to a fixed sheet of polarizing material 124 via a pulley drive 123 and a pulley 121. Sensor 100 itself is a CCD array which has an active area 101 exposed within a sensor mount 126. The CCD array requires external electronics to develop and output an image. The complete assembly is generally sold as a CCD camera by companies such as RCA.

OPERATION

Bail gimbal 56 provides a third rotational axis for the seeker which is a follow-up to the inner gimbal axis in yaw motion. The inner gimbal freedom has a relatively narrow angular range. This unconventional bail design allows the off-axis mounting of the gimbal support bearings to provide space for platform components while still permitting an overall small diameter. Platform positioning is controlled by torquer assembly 90 and resolver assembly 92 on each of the two inner axes of the platform. Counterweight 34 compensates imbalance of bail gimbal 56. Counterweight shaft 38 is gear driven by an intermediate motor shaft. Electrical wires can be brought off bail gimbal 56 as a flat ribbon looped beside the drive bands. The total number of pinch roller spindle 60's and support roller spindle 72's can be satisfied by eight ball bearings, four of which have tapered outer diameters. Four bearings under the bail surface can be cylindrical and rotated against the cylindrical surface of the bail. These bearings may be mounted on eccentric shafts for leveling and adjustment as previously described. Tapered bearings are mounted forward of the bail and oriented at a compound angle to roll without slippage against conical surfaces on the bail. Axial adjustment of the conical bearings is utilized for preloading. The bail support face can be fabricated from aluminum alloy and the rolling surfaces can be plated with electroless nickel or other hard metal for wear life. CCD camera electronics, signal buffer amplifiers, torquer amplifier and so forth, can be located inside or on the platform base of support frame 16. The overall seeker head is enclosed within a fused silica dome. The back of support frame 16 is sealed by o-rings and has a fill valve and relief valve, not shown, for purging with dry air. The use of dry air avoids condensation moisture and corrosion within the entire gimbal assembly. Electrical connections in the seeker head are made through miniature coaxial connectors and multi-pin rectangular connectors, also not shown. All the interconnecting wires are routed back to electronic section 20 as shown in FIG. 1.

A platform can be operated in two control modes: cage or boresight and track. In the cage or boresight mode, a resolver or potentiometer feedback is used to point each of the three gimbal axes to its zero position, with the seeker looking straight ahead along the missile longitudinal axis. Rate gyro feedback is used for stabilization of the inner two axes, while the bail gimbal uses a differentiation circuit on the potentiometer output. A type I servo loop is utilized which allows minor pointing errors off boresight during acquisition of moving targets. A type I servo loop lags the target if the target moves at constant rate. A type II servo loop design has also been utilized. Type II servo loops do not lag the target. They include integrators which compensate for lag time.

In the track mode, a tracker such as a digital tracker processes the CCD imagery to determine where the target is located relative to the center of the field of view. Vertical and horizontal error signals are generated and fed to the two platform inner axis servo amplifiers which cause the platform to rotate until it is looking toward the target. The track mode employs a type II servo loop to maintain lock on targets at high angular tracking rates. Rate feedback signals are the same as those used in the cage mode. Bail gimbal motion is commanded by the inner axis resolver so that it follows the inner axis and keeps the inner gimbal angle close to zero degrees. A smooth gain transition takes place as the platform mode is switched from cage to track. This permits control interactions between the tracker and platform servo loops. Sudden perturbations in platform motion can jump a small target out of the tracking gate and possibly result in complete loss of target track.

In this configuration, an additional operation mode, slave, can be included in platform control. This mode is similar to cage except that the platform can be pointed to any commanded direction and not just to boresight. Pointing commands can be generated either by external radar or other inputs fed to electronic section 20 of the missile prior to launch. This feature could be incorporated in platform design. Output of the two platform rate gyros permits direct use for missile guidance commands. The rate gyro outputs are equivalent to precession torques measured on a free gyro stabilized seeker.

It is obvious to those skilled in the art that numerous modifications to the above may be made.

What is claimed is:

1. A rate gyro stabilized gimbal tracking system comprising:

a support frame with counterweight assembly;
a platform mounted on said support frame;
a two-axis gimbal ring on said support frame mounted to said platform;
at least one rate gyro connected to said platform;
a lens system with a characteristic focal length and focal point attached to said platform;
a sensor mounted on said platform spaced from said lens system at the focal point of said lens system;
a light level control assembly connected to said sensor;
a bail connected to one axis of said two-axis gimbal ring;
a bail drive assembly mechanically connected to said bail; and
an electronic control assembly connected to said rate gyro and bail drive assembly.

2. A rate gyro stabilized gimbal tracking system as described in claim 1 where said bail drive assembly comprises:

a torque motor mounted to said support frame;
a torquer spindle mounted to said torque motor;
means for driving said bail connected to said torquer spindle;
a counterweight connected to said driving means; and
means for measuring the rotation of said torquer spindle.

3. A rate gyro stabilized gimbal tracking system as described in claim 2 where said driving means comprises a drive pulley assembly attached to said torquer spindle and at least one metal band joining said bail to said drive pulley.

4. A rate gyro stabilized gimbal tracking system as described in claim 2 where said driving means comprises a gear wheel mounted to said torquer spindle and a row of gear teeth on said bail.

5. A rate gyro stabilized gimbal tracking system as described in claim 2 where said bail drive assembly further comprises:

a plurality of support roller spindles set into said support frame; and
a plurality of pinch roller spindles mounted to said support frame.

6. A rate gyro stabilized gimbal tracking system as described in claim 3 where said bail drive assembly further comprises:

a plurality of support roller spindles set into said support frame; and
a plurality of pinch roller spindles mounted to said support frame.

7. A rate gyro stabilized gimbal tracking system as described in claim 4 where said bail drive assembly further comprises:

a plurality of support roller spindles set into said support frame; and
a plurality of pinch roller spindles mounted to said support frame.

8. A rate gyro stabilized gimbal tracking system as described in claim 1 where said two-axis gimbal ring further comprises a resolver assembly on each axis of said two-axis gimbal ring.

9. A rate gyro stabilized gimbal tracking system as described in claim 1 where said lens system further comprises a catadioptric lens assembly.

10. A rate gyro stabilized gimbal tracking system as described in claim 1 further comprising a heat sink and thermoelectric cooler thermally attached to said sensor.

11. A rate gyro stabilized gimbal tracking system comprising:

a support frame with counterweight assembly;
a platform mounted on said support frame;
a two-axis gimbal ring on said support frame mounted to said platform;
at least one rate gyro connected to said platform;
a lens system with a characteristic focal length and focal point attached to said platform;
a sensor mounted on said platform spaced from said lens system at the focal point of said lens system;
a bail connected to one axis of said two-axis gimbal ring;
a bail drive assembly connected to said bail which comprises:
a torque motor mounted to said support frame;
a torquer spindle mounted to said torque motor;

means for driving said bail connected to said torquer spindle, said driving means further comprising a gear wheel mounted to said torquer spindle and a row of teeth on said bail;

a counterweight connected to said driving means; and means for measuring the rotation of said torquer spindle; and an electronic control assembly connected to said rate gyro and measuring means.

12. A rate gyro stabilized gimbal tracking system as described in claim 11 where said bail drive assembly further comprises:

a plurality of support roller spindles set into said support frame; and a plurality of pinch roller spindles mounted to said support frame.

* * * * *